US012000094B2

(12) United States Patent
Barthel

(10) Patent No.: US 12,000,094 B2
(45) Date of Patent: Jun. 4, 2024

(54) ENHANCED RAIL GRINDING SYSTEM AND METHOD THEREOF

(71) Applicant: Loram Maintenance of Way, Inc., Hamel, MN (US)

(72) Inventor: Brian Patrick Barthel, Minneapolis, MN (US)

(73) Assignee: LORAM MAINTENANCE OF WAY, INC., Hamel, MN (US)

( * ) Notice: Subject to any disclaimer, the term of this patent is extended or adjusted under 35 U.S.C. 154(b) by 1115 days.

(21) Appl. No.: 16/358,694

(22) Filed: Mar. 20, 2019

(65) Prior Publication Data

US 2020/0299905 A1 Sep. 24, 2020

(51) Int. Cl.
*E01B 31/17* (2006.01)
*B24B 19/00* (2006.01)

(52) U.S. Cl.
CPC ..... *E01B 31/17* (2013.01); *B24B 19/004* (2013.01)

(58) Field of Classification Search
CPC ... B24B 19/004; B24B 49/12; B24B 27/0076; E01B 31/12; E01B 31/13; E01B 31/15; E01B 31/17; E01B 31/175
See application file for complete search history.

(56) References Cited

U.S. PATENT DOCUMENTS 4,115,857 A * 9/1978 Panetti ..... E01B 31/12 451/347
4,531,837 A * 7/1985 Panetti ..... G01B 11/2518 356/394
4,583,327 A * 4/1986 Jaeggi ..... E01B 31/17 451/347
4,622,781 A 11/1986 Vieau et al.
4,785,589 A 11/1988 Bühler
4,862,647 A 9/1989 Vieau
5,044,126 A 9/1991 Baldo
5,140,776 A 8/1992 Isdahl et al.
5,293,718 A 3/1994 Favaron
6,719,616 B2 4/2004 Mathison et al.
6,953,386 B1 10/2005 Korinek et al.
6,981,907 B1 1/2006 Korinek et al.
7,156,723 B2 1/2007 Natarajan et al.
(Continued)

OTHER PUBLICATIONS

PCT Search Report and Written Opinion for PCT Application No. PCT/US20/20744 dated Jun. 10, 2020, 7 pages.

*Primary Examiner* — Laura C Guidotti
*Assistant Examiner* — Sukwoo James Chang
(74) *Attorney, Agent, or Firm* — Husch Blackwell LLP

(57) ABSTRACT

Rail grinders and related methods of rail grinding in which custom grinding patterns are continually updated based upon an operational status of the rail grinder. The rail grinder includes a plurality of individual grinding modules that are individually arranged to generate the custom grinding patterns for individual rail segments. The custom grinding patterns allow the rail grinder to grind a desired rail profile for each rail segment in a minimum number of grinder passes and at a maximum operating speed for the rail grinder. Utilizing a variety of inputs including current rail conditions, desired rail profile, rail segment type, available grinding modules and grinding module style, a processing system either on-board or remotely located from the rail grinder can iteratively develop a custom grinding pattern that is temporally unique to each rail segment.

20 Claims, 8 Drawing Sheets

(56) References Cited

U.S. PATENT DOCUMENTS

| | | | | |
|---|---|---|---|---|
| 2003/0083001 | A1 | 5/2003 | Natarajan et al. | |
| 2005/0279240 | A1 | 12/2005 | Pedanekar et al. | |
| 2015/0111472 | A1* | 4/2015 | Palese ..... | E01B 31/17<br>451/5 |

* cited by examiner

ENHANCED RAIL GRINDING SYSTEM AND METHOD THEREOF

TECHNICAL FIELD

The present application is directed to rail grinders used for maintaining railways. More particularly, the present application is directed to a system for creating custom rail grinding patterns that allow for rail grinding to be performed at a fastest possible speed when grinding a desired rail profile.

BACKGROUND

Railroad tracks generally comprise a pair of metal rails arranged in a parallel configuration so as to guide and support metal wheels of train cars. Use of these tracks to support heavy loads travelling at high speeds can result in the formation of irregularities such as pits, burrs, cracks and deformations along the track surface. These irregularities can create excessive noise and vibrations as the wheels of the train car contact the irregularities. Similarly, the irregularities can also increase the fatigue on the rails and the train cars themselves creating substantial safety and maintenance problems.

A common method of removing irregularities from the track in situ comprises pulling at least one rotating grinding stone that includes an abrasive surface along the track to grind the track surface so as to smooth out irregularities and remove fatigued metal without having to remove the track section. One of the primary concerns with grinding out the irregularities without removing the track section is ensuring that the entire track surface is contacted by the abrasive surface so as to avoid missing any irregularities. Because of factors including different load weights and configurations of the trains traveling over the rails or even installation factors such as, for example, differing soil conditions beneath the rails, the track surface can wear unevenly along the railway. This makes it even more important that the entire rail profile be contacted by an abrasive surface during the grinding operation. In response to this requirement, a variety of different grinding configurations have been developed are currently available to grind the entire rail profile.

One common method of rail grinding involves the use of rail grinding machines that include a plurality of individually adjustable grinding units. These rail grinders can range from large mainline grinders having upwards of 50 or more individual grinding modules per side or smaller custom grinders that provide more operational flexibility at encumbered portions of the railway such as at crossings or switchyards. Regardless of the size of the rail grinder, each grinding module is generally used to grind a single portion of the rail profile or facet such that cooperatively all of the grinding modules on the rail grinder sequentially and cooperatively grind the entirety of a desired rail profile.

In conventional operation, each rail grinder generally has a fixed number of potential patterns by which the individual grinding modules can be arranged. Based on the condition of the rail and the location, for example, straight, parallel portion or curves, an operator would select the appropriate pattern. This selection required skill and experience and was limited to the available, pre-programmed patterns. As such, it would be advantageous to improve upon the operation of rail grinders by allowing the customization of grinding patterns and arrangements based on the unique circumstances present at individual railway locations.

SUMMARY

Representative rail grinders and related methods of rail grinding according to the present invention continually update an operational status of individual grinding modules on the rail grinder to generate custom grinding patterns for individual rail segments. Generally, these custom grinding patterns allow the rail grinder to grind a desired rail profile for each segment in a minimum number of grinder passes and at a maximum operating speed for the rail grinder. Utilizing a variety of inputs including, for example, current rail surface conditions, desired rail profile, rails segment type, available grinding modules and grinding module style, a processing system either on-board or remotely located from the rail grinder can iteratively develop a custom grinding pattern that is temporally unique to each rail segment. With the custom grinding pattern developed, the processing system can arrange the individual grinding modules and direct the operation of the rail grinder at a determined speed and number of passes over the rail segment. In a preferred embodiment, the custom grinding pattern is developed for each segment as the rail grinder is in the process of grinding a preceding rail segment. As such, the custom grinding pattern is developed for each segment using essentially real-time operational data associated with the rail grinder and the individual grinding modules.

In one aspect, the present invention is directed to a method for rail grinding that comprises identifying an amount of metal to be removed from each rail using data on the physical and operational status of each rail as well as a desired rail profile target. The physical and operational status can be previously collected or can include real-time collection by a rail grinder while the desired rail profile target is typically unique to a railway operator and can reflect the type and arrangement of rail being ground. Once the amount of metal to be removed has been determined, a custom grinding pattern is iteratively determined based on both a configuration of individual grinding modules and the real-time operational availability of each individual grinding module. The custom grinding pattern can involve determining a maximum operational speed at which the rail grinder traverses the rail as well as determining a minimum number of passes necessary for the rail grinder to successfully remove the necessary metal to achieve the rail profile target. When determining the maximum operational speed, the custom grind pattern is continually reevaluated at each speed. Development of the custom grind pattern also takes into account individual grinding setpoints of each grinding module, for example, available horsepower and whether or not a grind angle of each grinding module is fixed or flexible.

In another aspect, the present invention is directed to a railway grinding system that is capable of generating custom grind patterns when grinding individual rail segments of a railway. Generally, the railway grinding system can comprise a rail grinder having a rail grinding assembly on each side of an on-rail vehicle. Each rail grinding assembly can comprise a plurality of individual grinding modules that cooperatively grind a desired rail profile into each rail as the rail grinder traverses the railway. The rail grinder further comprises a processing system, either onboard or remotely located, that determines and implements a custom grind pattern for successive segment of the railway. The processing system utilizes a variety of data sources including, for example, an operational availability of each of the plurality of individual grinding modules, operational parameters of each of the plurality of individual grinding modules, an amount of metal that must be removed from each rail and a desired target profile that can be unique to each railway operator and can be unique to successive rail segments to create a custom grinding profile for each rail segment. Preferably, the processing system allows the custom grinding profile for the rail segment as the rail grinder is in the process of grinding a preceding rail segment such that the custom grinding profile is generated with the most up to date operational parameters for each individual grinding module.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1:
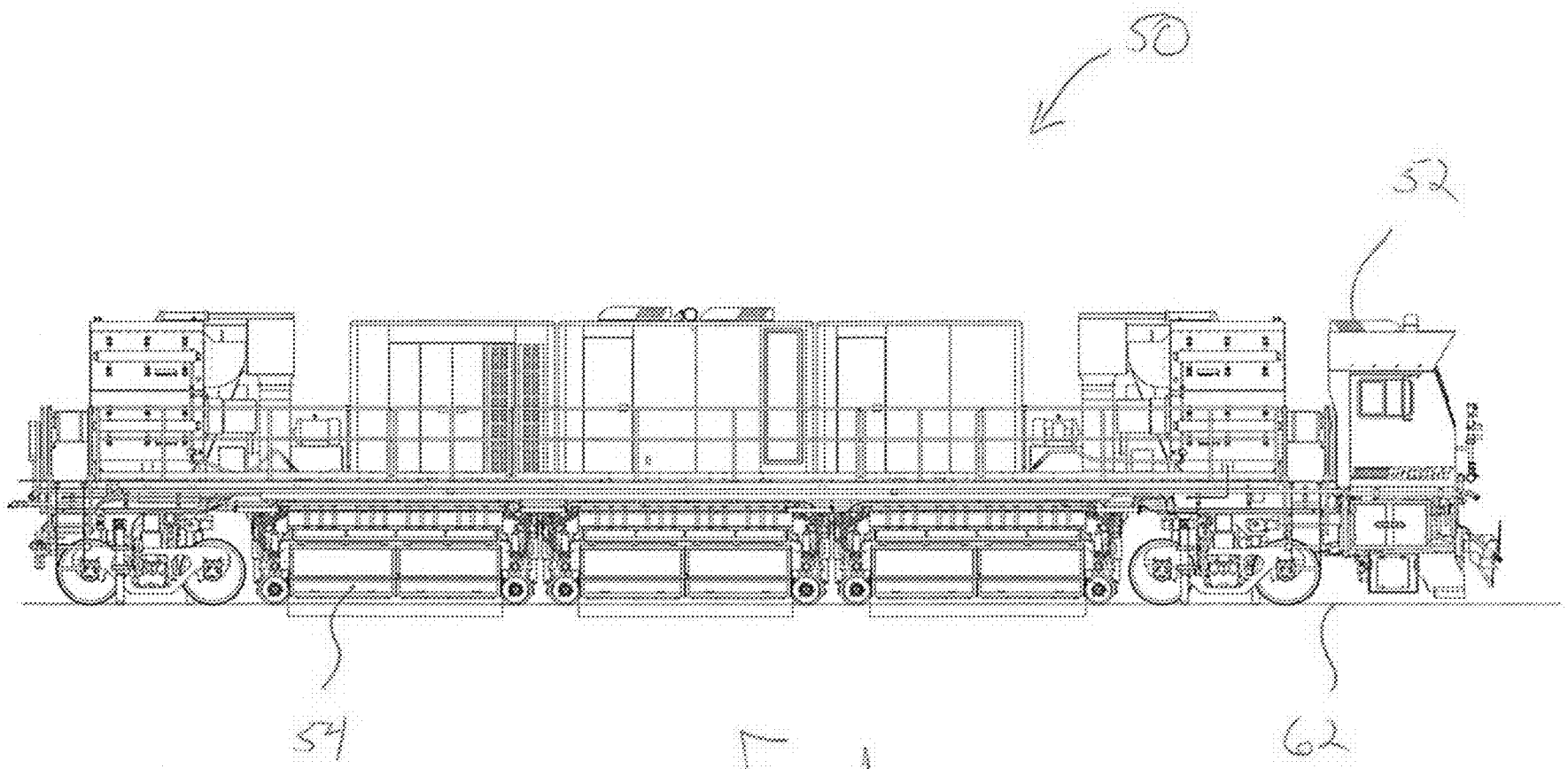
FIG. 1 is a side view of a representative rail grinder according to the prior art.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

Figure 2:
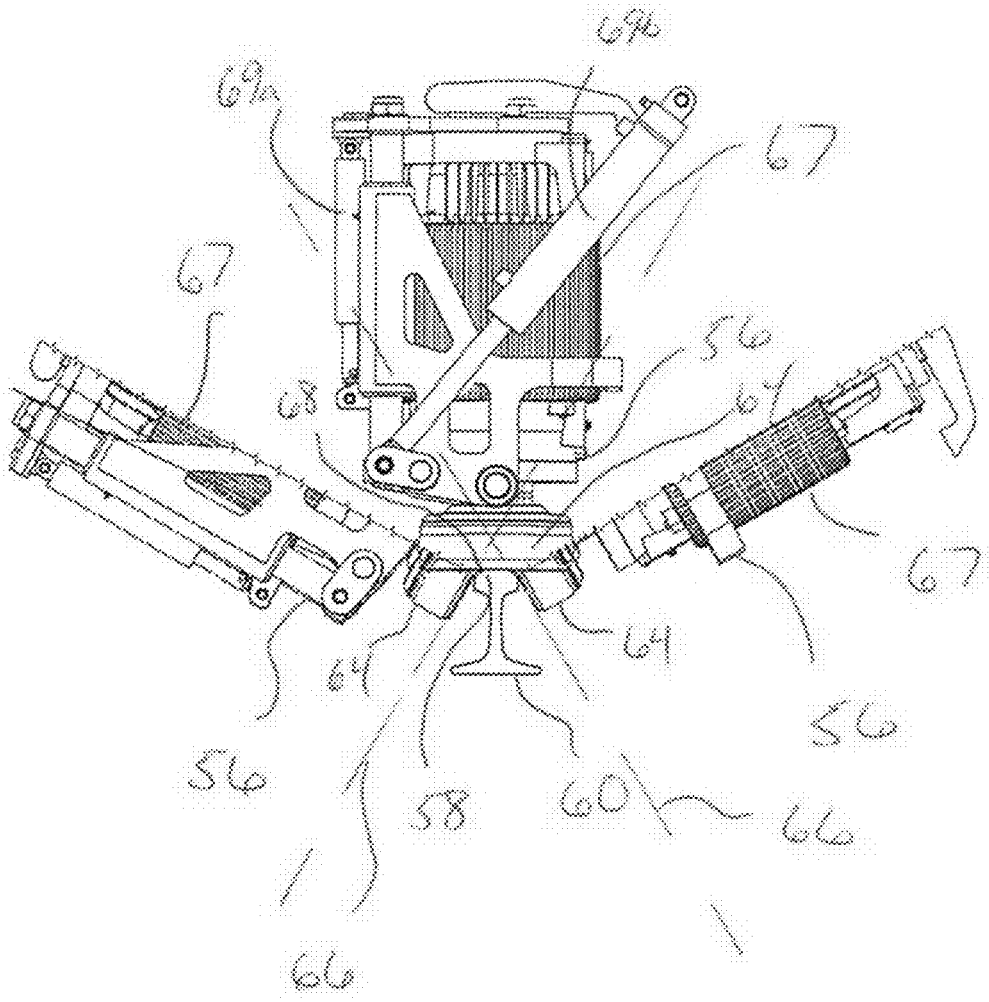
FIG. 2 is a section view of a length of rail being engaged by representative grinding modules.

Referring now to FIGS. 1 and 2, a conventional rail grinder 50 of the prior art can comprise a powered on-rail vehicle 52 with a rail grinding assembly 54 on each side of the vehicle 52. Generally, each rail grinding assembly 54 comprises a plurality of individually controlled grinding modules 56 which sequentially and cooperatively grind a rail profile 58 on each rail 60 as the rail grinder 50 traverses a railway 62. Each rail grinding assembly 54 is individually controllable and positionable such that a grinding stone 64 can be oriented and positioned to grind an individual facet 66 of the rail profile 58. Generally, each rail grinding assembly 54 can comprise a motor assembly 67 for providing a desired rotational speed and horsepower as well as vertical and horizontal positioning assemblies 69*a*, 69*b* that allow each grinding stone 64 to engage an upper surface 68 of rail 60 and remove a desired amount of metal at that facet location such that when the rail grinder 50 has fully traversed the rail, the desired rail profile 58 remains.

Figure 3:
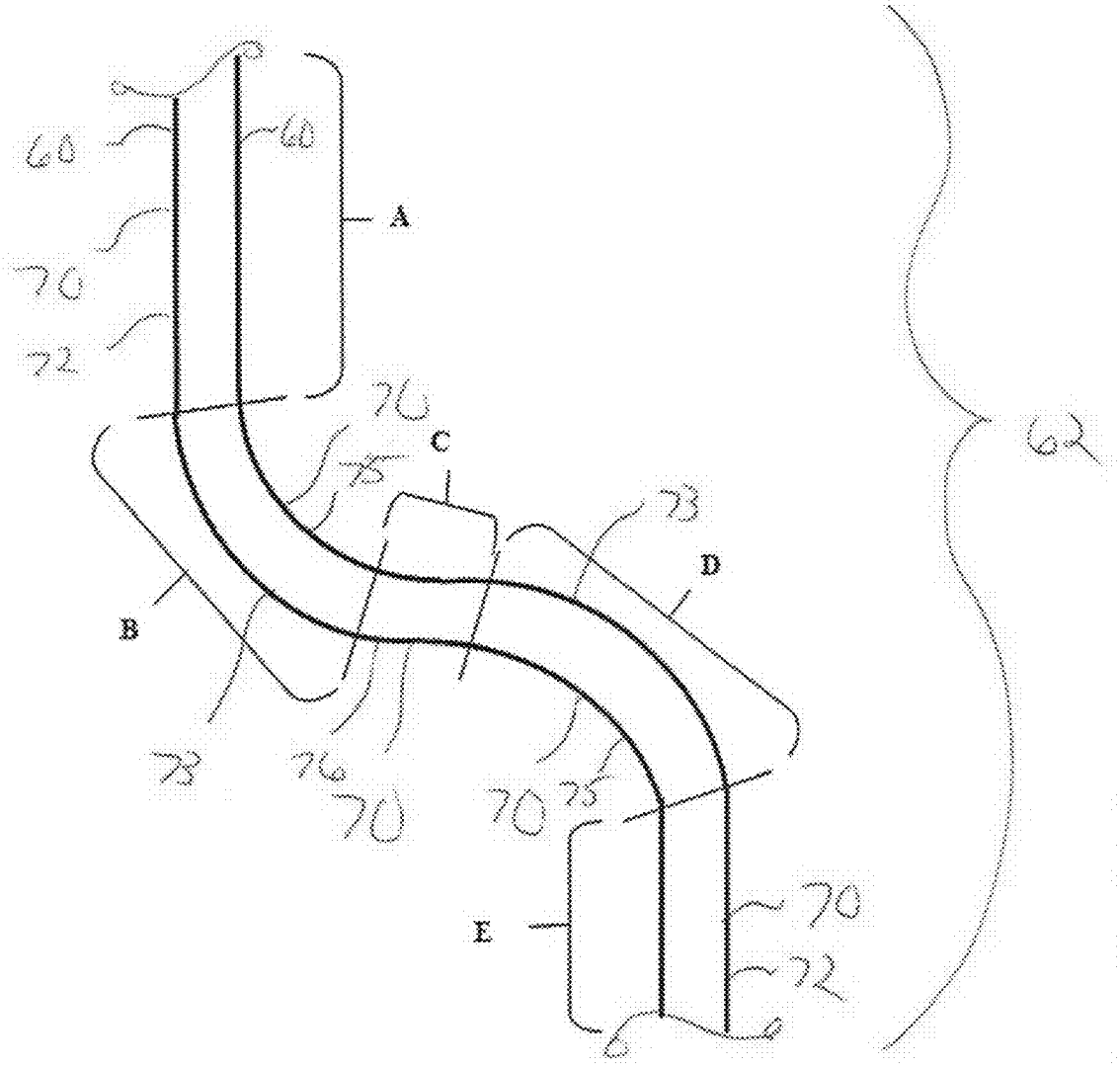
FIG. 3 is a top view of a railway having a plurality of defined grinding segments.

As shown in FIG. 3, a railway 62 can be broken into various segments 70 that will experience different forces and wear as rail traffic passes over the segments 70. For example, segments "A" and "E" constitute straight line segments 72 wherein the pair of rails 60 reside in a parallel orientation. Segments "B" and "D" represent curved segments 74 wherein the curvature is represented by a high rail 73 (the outermost rail 60 in the curve) and a low rail 75 (the innermost rail 60 in the curve). As shown in FIG. 3, the direction of segments "B" and "D" means that the designation of the high rail 73 and low rail 75 switches between the rails 60. Finally, segment "C" represents a transition segment 76. Based on factors such as, for example, overall usage, operational speeds and operational weight, railroads will generally have desired rail profiles 58 that vary for each of the segments 70. As such, maintenance of these segments 70 using rail grinder 50 will generally require a different configuration or pattern for the grinding modules 56 at each segment 70.

Figure 4:
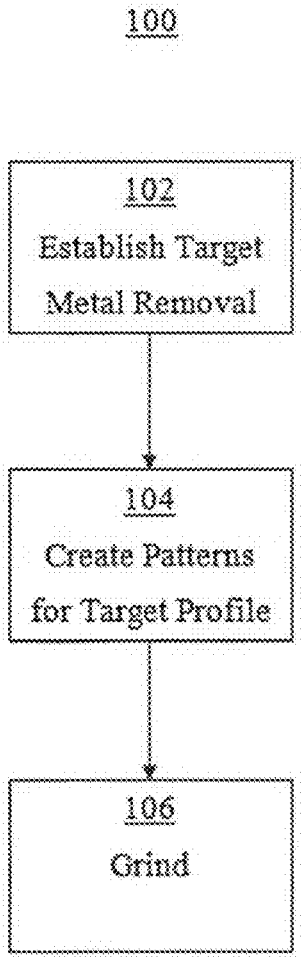
FIG. 4 is a flow chart illustrating a method for grinding rail with custom grind patterns according to an embodiment of the present invention.

A representative method of railway grinding 100 according to the present invention is illustrated schematically in FIG. 4. Generally, method of railway grinding 100 can comprise a first step 102 of establishing a targeted amount of metal to be removed from each rail. First step 102 is subsequently discussed in further detail with respect to FIG. 5. A second step 104 can comprise creating grinding patterns to achieve a target profile of the finished rail as discussed in detail with respect to FIG. 6 below. Finally, the method of railway grinding 100 can comprise a third step 106 of grinding the rail such that the finished rail has a finished rail profile substantially resembling the target profile. Generally, grinding step 106 is accomplished in a conventional manner but at the optimized grinding conditions as determined utilizing steps 102 and 104.

In order to accomplish the representative method of railway grinding 100 and the subsequent, iterative processing steps that will be described below, it will be understood that rail grinder 50 can comprise a local onboard processing system and/or a remote processing system capable of communicating with rail grinder 50 in real time. The processing system can include a suitable processor, memory user inputs, user displays and communication systems utilizing conventional communication protocols. The processor can include various engines, each of which is constructed, programmed, configured, or otherwise adapted, to autonomously carry out a function or set of functions. The term "engine" as used herein is defined as a real-world device, component, or arrangement of components implemented using hardware, such as by an application specific integrated circuit (ASIC) or field-programmable gate array (FPGA), for example, or as a combination of hardware and software, such as by a microprocessor system and a set of program instructions that adapt the engine to implement the particular functionality, which (while being executed) transform the microprocessor system into a special-purpose device. An engine can also be implemented as a combination of the two, with certain functions facilitated by hardware alone, and other functions facilitated by a combination of hardware and software. In certain implementations, at least a portion, and in some cases, all, of an engine can be executed on the processor(s) of one or more computing platforms that are made up of hardware (e.g., one or more processors, data storage devices such as memory or drive storage, input/output facilities such as network interface devices, video devices, keyboard, mouse or touchscreen devices, etc.) that execute an operating system, system programs, and application programs, while also implementing the engine using multitasking, multithreading, distributed (e.g., cluster, peer-peer, cloud, etc.) processing where appropriate, or other such techniques. Accordingly, each engine can be realized in a variety of physically realizable configurations, and should generally not be limited to any particular implementation exemplified herein, unless such limitations are expressly called out. In addition, an engine can itself be composed of more than one sub-engine, each of which can be regarded as an engine in its own right. Moreover, in the embodiments described herein, the various engines can correspond to a defined autonomous functionality; however, it should be understood that in other contemplated embodiments, each functionality can be distributed to more than one engine. Likewise, in other contemplated embodiments, multiple defined functionalities may be implemented by a single engine that performs those multiple functions, possibly alongside other functions, or distributed differently among a set of engines than specifically illustrated in the examples herein.

Various embodiments and/or portions of the method of railway grinding 100 can be performed using components of functions provided either onboard the railway grinder 50 as well as those available in cloud computing, client-server, or other networked environments, or any combination thereof. The components of the system can be located in a singular "cloud" or network, or spread among many clouds or networks. End-user knowledge of the physical location and configuration of components of the system executing method 100 is not required. For example, processors, memory, endings and sensors can be combined as appropriate to share hardware resources, if desired.

Typically, method 100 can utilize one or more processors or programmable devices operating autonomously or in parallel that accept analog or digital data as an input, are configured to process the input according to instructions or algorithms, and provide results as outputs. In an embodiment, the processor can be a central processing unit (CPU) configured to carry out the instructions of a computer program. The processor is therefore configured to perform at least basic arithmetical, logical, and input/output operations. The processor can interface with memory, for example, volatile or non-volatile memory to provide space to execute the instructions or algorithms and iterations thereof, but to provide the space to store the instructions themselves. In embodiments, volatile memory can include random access memory (RAM), dynamic random access memory (DRAM), or static random access memory (SRAM), for example. In embodiments, non-volatile memory can include read-only memory, flash memory, ferroelectric RAM, hard disk, floppy disk, magnetic tape, or optical disc storage, for example. The foregoing lists in no way limit the type of memory that can be used, as these embodiments are given only by way of example and are not intended to limit the scope of the invention.

Figure 5:
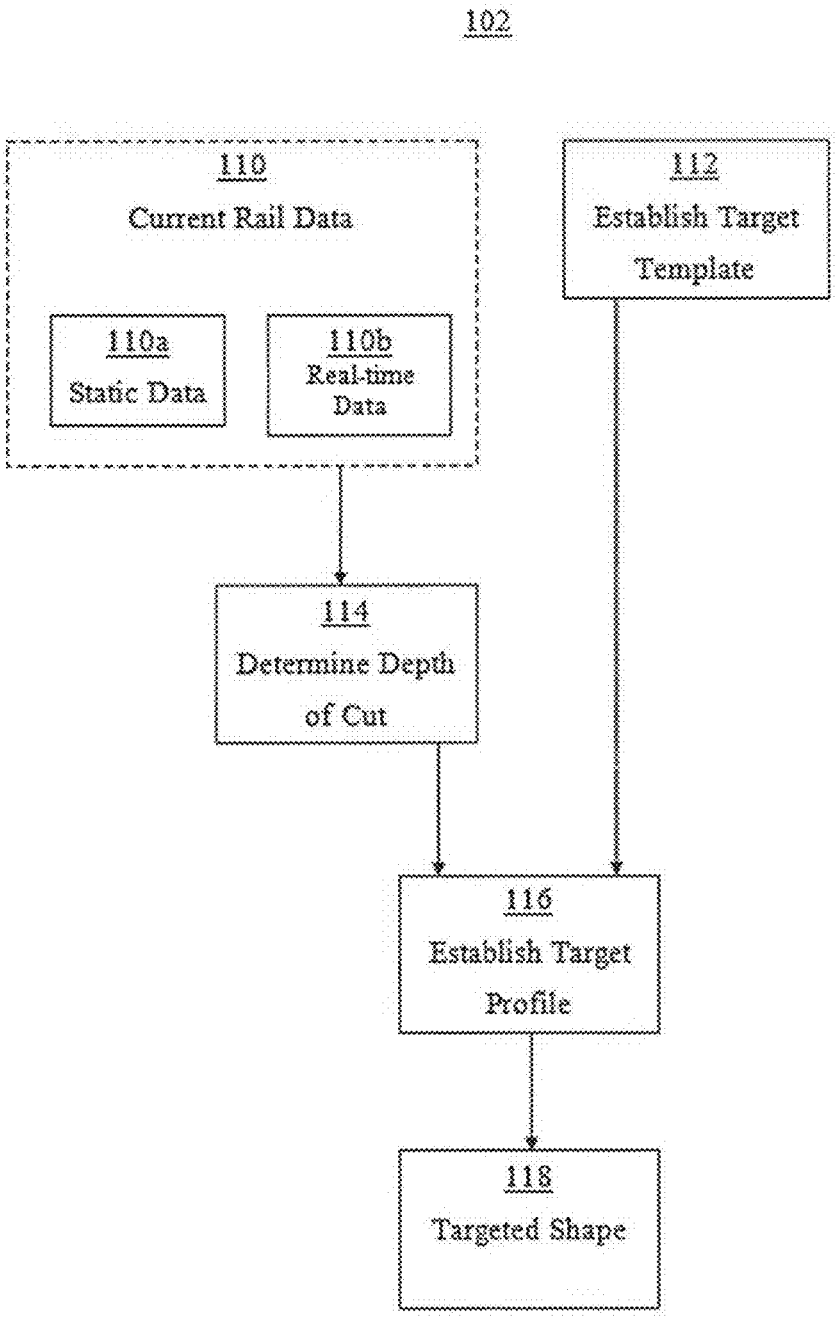
FIG. 5 is a flow chart illustrating a method for determining an amount of metal to be removed from a rail so as to arrive at a targeted shape.

First step 102 of establishing an amount of metal to be removed from each rail is more specifically illustrated in FIG. 5. Generally, first step 102 requires data inputs related to the current condition of rail as well as desired rail profile targets that will vary between segments 120 and that can differ between railway companies and applications, for example, heavy haul railways versus light rail transit. Generally, step 110 involves collecting or uploading current rail data to a computer processor. The rail data can comprise one or both of static rail data 110*a* or real-time rail data 110*b*. Static rail data 110*a* can include, for example, data collected using rail inspection vehicles that have traversed the railway either days or weeks prior to railway grinding 100, historical data maintained by a railway company or maintenance data accumulated by a railway maintenance company doing prior maintenance work. Static rail data 110*a* can be stored in suitable computer memory on-board the rail grinder 50, or alternatively, can be continually downloaded from a remote storage location or from cloud storage using a suitable wireless communications protocol. Real-time data 110*b* can include data collected just prior to railway grinding 100 and can include data accumulated by an inspection vehicle operating in front of and in conjunction with the rail grinder 50, or alternatively, the real-time data 110*b* can be collected using appropriate sensors and location identifiers on the rail grinder 50 itself. As real-time data 110*b* is collected, it can be stored using appropriate computer memory on-board the rail grinder 50 and/or uploaded to a remote storage location or to cloud storage using a suitable wireless communications protocol.

Whether step 110 involves one or both of static rail data 110*a* or real-time data 110*b*, the type of data generally will reflect the physical and operational status of each rail 60. Representative data generally identifies metal fatigue, the current rail head profile and mechanical defects in rail 60. Data can be collected using any of a variety of appropriate rail sensors including, for example, LiDAR (Light Detection and Ranging), GPS sensors (Global Positioning Sensors), optical sensors and cameras and the like.

Based on the data collected or uploaded in step 100, the processor identifies metal that must be removed to remove any defects, corrosion or other rail problems. In step 114, the processor determines a depth of cut or grind that must be performed by the rail grinder 50 such that the rail 60 will be free of defects upon completion of railway grinding 100.

Once the depth of cut is determined in step 114, this information is compared to a target profile template that is established in step 112. The target profile template is generally specified by an operator of the railway 62. As discussed previously, the target profile template can differ between rail operators and between types of rail installations, for example, heavy haul or light rail transit railways. In addition, the target profile template can vary between segments 70 of the railway 62, for example, straight line segments 72 and curved segments 74 or between the high rail 73 and low rail 75. In step 116, a target profile is established that results in the rail 60 having a rail profile 58 whereby all of the defective metal has been ground away and the result matches the desired rail profile of the particular segment 70. From step 116, a target shape 118 is created upon which customized grind patterns will be subsequently created for the rail grinder 50 and the individual segments 70.

Figure 6:
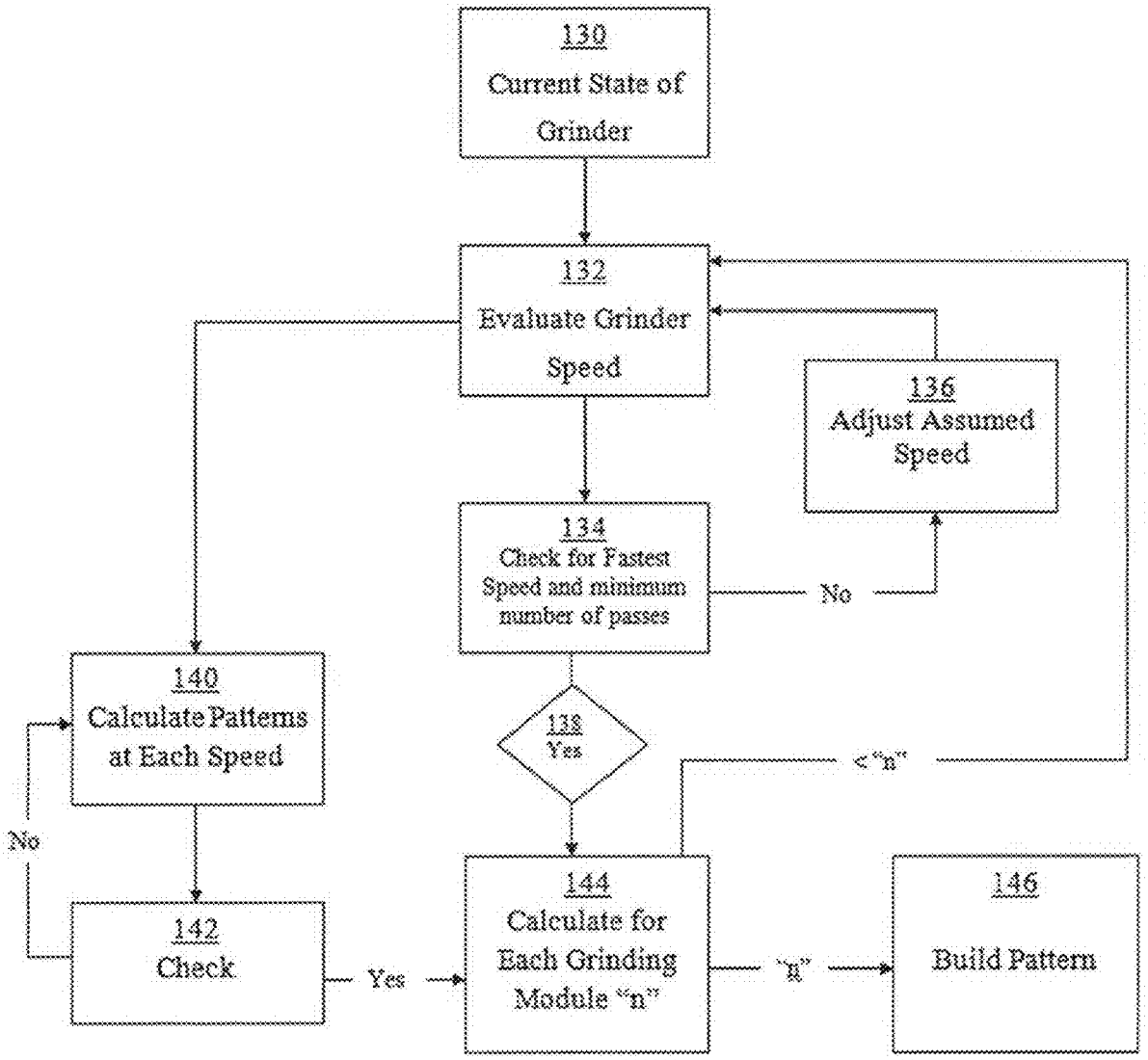
FIG. 6 is a flow chart illustrating a method for creating custom grinding patterns that are capable of grinding the targeted shape in the fewest passes and fastest speed.

With reference to FIG. 6, the step 104 of creating custom grinding patterns to achieve the target shape 118 for rail 60 by an iterative process is detailed. With the processor having determined the target shape 118, the operational status of the rail grinder 50 is updated in step 130. For example, a conventional rail grinder 50 can have up to one hundred twenty grinding modules 56 (or sixty grinding modules 56 per side) when fully operational though the present invention is not limited by minimum and maximum values for the number of grinding modules 56. During maintenance operations, it is not uncommon for one or more of these grinding modules 56 to be out of service or otherwise unavailable due to mechanical breakdown or wear. As such, the custom grinding patterns created in step 104 are built using the actual operational status of the rail grinder 50 at the time of rail grinding as opposed to creating profiles based on an assumed or best case operational status that may not be achievable at the time of rail grinding. Furthermore, the number of operational grinding modules 56 on each side of the rail grinder 50 may not be equal such that step 104 may determine different grind patterns for each rail 60 within a single segment 70.

Using the operational parameters identified in step 130, construction of the grind pattern begins by evaluating an operational grinding speed for rail grinder 50 in step 132. Generally, rail grinder 50 is designed for operation within a range of grinding speeds such as, for example, between 3.0 mph-25.0 mph. In step 132, a first speed within this operational range is selected for evaluation. Using the first speed, calculations are conducted in parallel to determine a fastest grinder speed with the minimum number of grind passes in step 134 and to determine if the rail grinder 50 can achieve the target shape 118 at the first speed.

In step 134, if the processor determines the rail grinder 50, in its current operational status, can remove the amount of metal identified in step 114 from the segment 70 in less than one grind pass, the first speed is assumed to increase by 1 mph in step 136 and the determination is repeated. This process is repeated until it is determined that the rail grinder 50 requires more than one pass to accomplish the desired rail grinding or the first speed is equal to the maximum operational speed. At this point, the prior highest speed that was possible with a single pass is assumed to increase by smaller increments, for example, an increase of 0.1 mph in step 136 and the determination is repeated. This process is repeated until it is determined that the rail grinder 50 requires more than one pass to accomplish the desired rail grinding or that the next incremental speed increase would be equal to the previously determined speed that resulted in more than one pass being required.

If instead, the processor determines the rail grinder 50 cannot grind the required metal identified in step 114 from the segment 70 in less than one grinder pass in step 134, the first speed is assumed to decrease by 1 mph in step 136 and the determination is repeated. This process is repeated until it is determined that the rail grinder 50 can accomplish the rail grinding in a single pass or the assumed speed is equal to the minimum operational speed. If at some point of the iterative process, it is determined that there is a speed that can accomplish a single pass, this speed is assumed to increase by a smaller increment, for example, 0.1 mph in step 136 and the determination is repeated. This process is repeated until it is determined the highest speed that the rail grinder 50 can operate and still achieve single pass metal removal.

Ultimately, the iterative speed process of steps 132 and 134 will in step 138 identify the highest speed rail grinder 50 can operate at with the minimum number of passes over the rail 60. This highest operating speed identified in step 138 is retained for further use as described below. When identifying the highest speed rail grinder 50 can operate, Simultaneously with the speed evaluation of steps 134 and 136, grind patterns necessary at each speed are calculated at step 140 with each pattern being evaluated in step 142 to determine if the target shape 118 can be achieved by the pattern. Calculation of the grind patterns at step 140 take into account the grinding parameters of the rail grinder 50 such as, for example, minimum and maximum grind angles achievable by the rail grinder 50, clash angles at which motors on each side of the rail grinder 50 cannot simultaneously grind, minimum and maximum amperage setpoints for motors on the individual grinding modules 56, the number of available grinding modules 56 on each side of the rail grinder 50 and the configuration of the available grinding modules 56, for example, fixed versus adjustable angle capability. If the calculated grind pattern can grind target shape 118, the grind pattern at that speed is retained for further use.

In step 144, the highest speed identified in step 138 is combined with the corresponding grind pattern established in step 132 to determine the individual arrangement of each grinding module 56. The individual arrangements will include the vertical and horizontal positioning of each grinding stone 64 as well as the horsepower required for each grinding stone 64 to grind the rail facet the individual grinding module 56 will be responsible for grinding. Generally, rail grinder 50 will include a plurality or "n" number of grinding modules 56 such that the arrangement of all "n" grinding modules is individually calculated starting with a forward most grinding module and proceeding sequentially to the rearward most grinding module. At this point, the actual grinding pattern is constructed in step 146 and includes complete grind arrangement information for each grinding module 56 and a maximum grinding speed over which the rail grinder 50 can traverse the segment 70.

When determining the highest grind speed in step 138 and the grind pattern of step 132, the method can further include an assumption that the second step 104 of creating grinding patterns will assume that grinding can be performed in a peak/plow fashion. Generally, peak grinding initially deals with "peaking" the rail 60, i.e., grinding the shoulders or corners proximate the gage and field sides of rail profile 58 while plow grinding involves the subsequent "plowing" of the rail 60, i.e. grinding the "crown" or middle facets of rail profile 58 to achieve the target shape 118. When multiple passes are required, for example, two passes, a first pass can be assumed to "peak" rail 60 while a second pass "plows" rail 60. If only a single pass is required, rail grinder 50 can be set up with a front portion, i.e, a front half of the grinding modules 56 on rail grinder 50, assumed to be "peaking" rail while a rear portion, i.e. a rear half of the grinding modules 56 on rail grinder 50, assumed to be "plowing" rail.

The "n" number of grinding modules 56 on a conventional rail grinder 50 can be made up of both fixed grinding modules **56*a* and flexible grinding modules 56*b*. Generally, the grinding stone 64 in the fixed grinding modules 56*a* are arranged at a fixed angle for essentially grinding the same facet as the rail grinder 50 moves along railway 62 and transitions between segments 70. Typically, the fixed grinding module 56*a* includes only a vertical positioning assembly that selectively directs the grinding stone 64 into and out of operable contact with the rail 60. Alternatively, flexible grinding modules 56*b* include both vertical and horizontal positioning assemblies that allow the angle at which the grinding stone 64 interacts with the rail 60 during grinding. During the process of calculating grind patterns at step 140 and evaluating the grind patterns in step 142, the individual configuration of each grind module 56 is evaluated as shown in FIGS. 7 and 8**.

Figure 7:
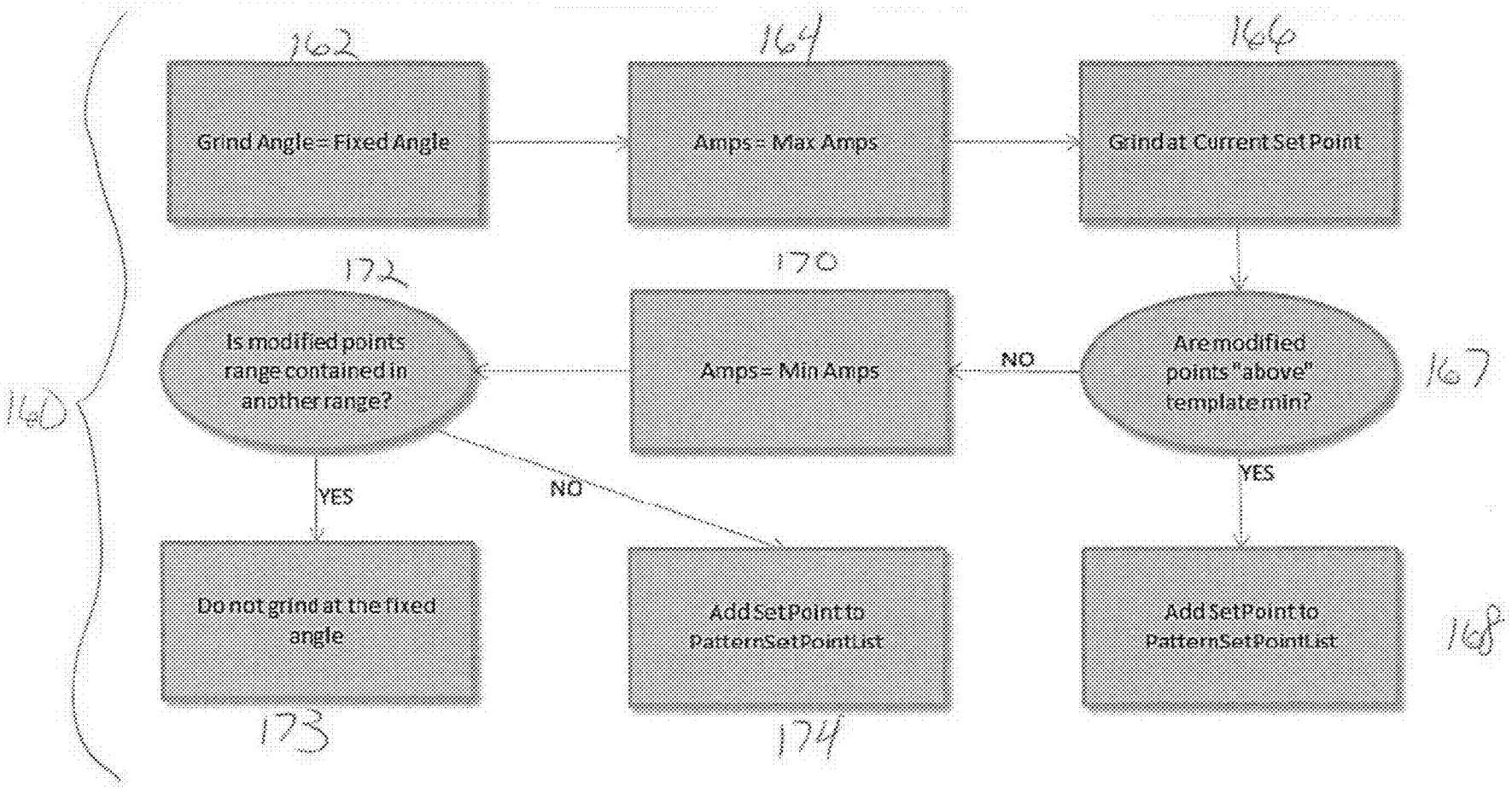
FIG. 7 is a flow chart illustrating a method for evaluating grind setpoints for individual fixed grinding modules.

As illustrated in FIG. 7, a process 160 for evaluating fixed module grinding generally identifies whether or not each individual fixed grinding module **56*a* is necessary to grind a single, continuous surface that achieves the target shape 118. In step 162, the individual grind angle of the fixed grinding module 56*a* is noted and combined with a maximum motor output in step 164 to establish a grind setpoint in step 166. The grind setpoint of step 166 is then compared to the target shape 118 in step 167. If the grind setpoint 166 is capable of leaving a facet that does not grind deeper or remove more metal than required by the target shape 118, the grind setpoint is added to grind pattern setpoint list in step 168. If instead, the grind setpoint 166 results in a facet being left that is ground deeper or removes too much metal than is required by target shape 118, the motor output is set to a minimum amperage in step 170 and modified grind setpoints are compared to the target shape 118 in step 172. If the grind results do not match the target shape 118, the individual fixed grinding module 56***a* is removed from the grind pattern setpoint list at step 173 and prevented from grinding at segment 70. If the grind results from step 172 match the target shape 118, the modified grind setpoints are added to the grind pattern setpoint list in step 174.

Figure 8:
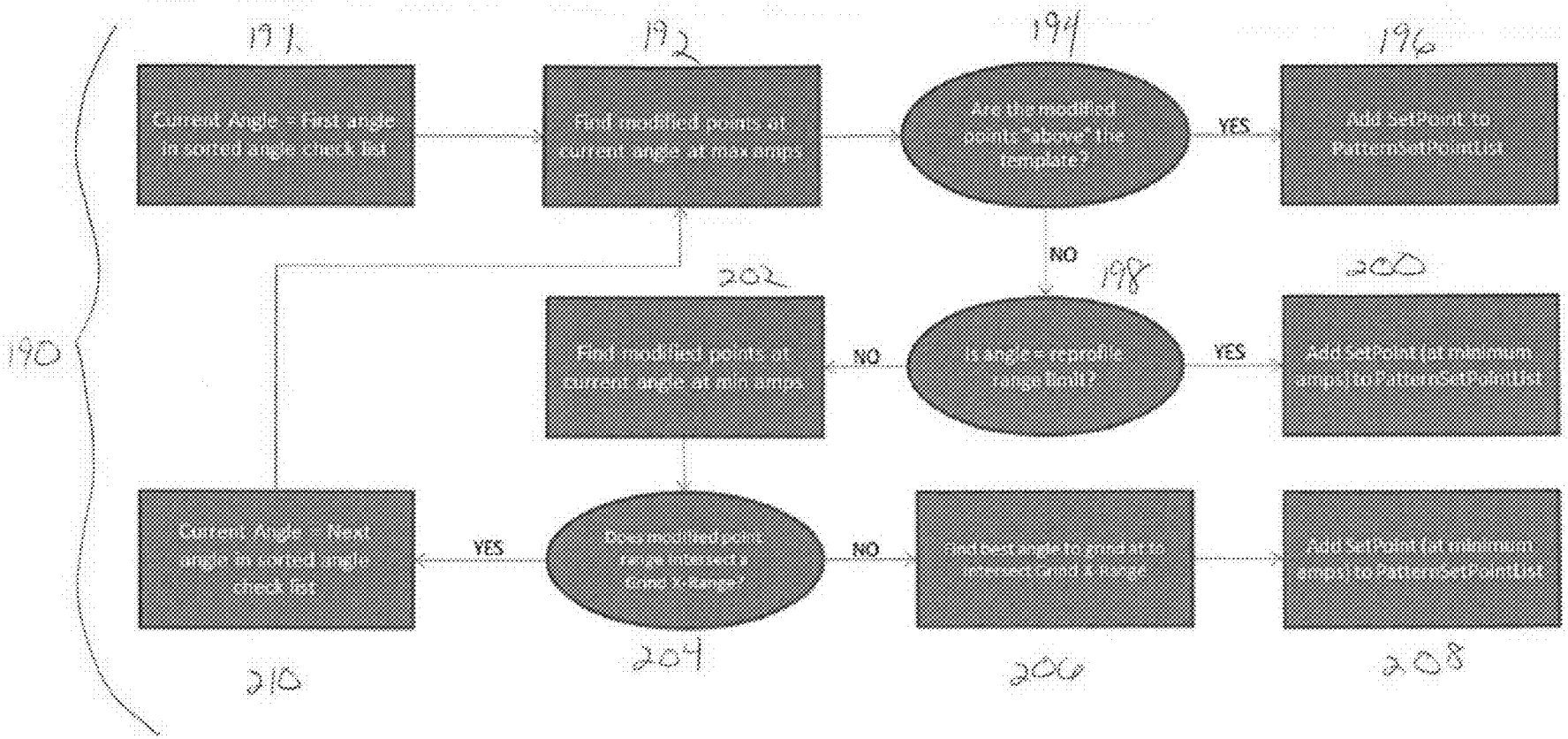
FIG. 8 is a flow chart illustrating a method for evaluating grind setpoints for individual flexible grinding modules.

As illustrated in FIG. 8, a process 190 for evaluating flexible module grinding generally identifies both the motor output and angle of grinding stone 64 for each individual flexible grinding module 56*b*. Generally, process 190 begins by choosing an initial module setpoint having an initial grinding stone angle in step 191 and assuming maximum motor amperage in step 192. The initial module setpoint is compared to the target shape 118 in step 194 to determine if the facet to be ground is not deeper or more metal is removed than necessary to achieve target shape 118. If with the initial module setpoint, the facet is not too deep and too much metal is not removed, the initial module setpoint is added to the grind pattern setpoint list in step 196. If the initial module setpoint results in a facet being ground to deep and too much metal being removed, the angle of grinding stone 64 is compared to a reprofile range limit in step 198. If the angle of grinding stone 64 satisfies the reprofiled range limit, the initial module setpoint is added to the grind pattern setpoint list but at minimum motor amperage in step 200. If the angle of grinding stone 64 fails to satisfy the reprofiled range limit, the initial module setpoint is adjusted by lowering the motor amperage by a set amount of amps in step 202. The modified grind pattern in step 202 is compared to the target shape 118 in step 204. If the modified grind pattern of step 202 fails to match the target shape 118, the best angle for grinding is identified in step 206 and added to the grind pattern setpoint list in step 208. If the grind pattern in step 202 matches the target shape 118, a next grinding stone angle for testing is determined in step 210. Using the next grinding stone angle from step 210, the initial module setpoint is reset for step 192 and process 190 is repeated.

If in step 138, the rail grinder 50 requires multiple passes over rail 60 to achieve grinding of the target shape 118, process 190 for the flexible grinding modules 56*b* is repeated but the individual setpoints are determined in reverse order for intermediate even pass numbers, from the rear of the grinder to the front of the grinder. Final passes over rail 60 are always performed in a forward direction such that the rail grinder 60 is moving in a forward direction when grinding of segment 70 is completed. Process 160 is not changed because the fixed grinding modules 56*a* are fixed in location on the rail grinder 50. As an additional pass would be required, any differences resulting from the fixed grinding modules 56*a* actually grinding in a different sequence can be accounted for on a subsequent forward pass.

The method of railway grinding 100 described herein is especially advantageous due to the calculation and determination of grind patterns based upon the actual operational condition of the railway grinder 50 as it approaches the segment 70 that is to be worked on. While the earlier collection of static rail data 110*a* could allow for grind patterns to be calculated at a time prior to the railway grinder 50 reaching segment 70, the railway grinder 50 may not be capable of achieving the target profile 118 with this predetermined pattern if one or more of the fixed or flexible grinding modules 56*a*, 56*b* are damaged or otherwise out of service when the railway grinder 50 reaches the start of segment 70. As the method of railway grinding 100 is based upon the actual operational condition of railway grinder 50, the method of railway grinding 100 allows target shape 118 to be achieved at a highest operational speed and with the lowest number of passes.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

The invention claimed is:

1. A method for grinding railway, comprising:

traversing a railway with a rail grinder, the railway defined by a plurality of segments;

updating an operational status of the rail grinder in real-time, the operational status indicating which of a plurality of grinding modules are available to grind a next segment of the plurality of segments, wherein said operational status excludes grinding modules that are out of service;

determining a grind pattern necessary to achieve a target profile for the next segment based upon the updated operational status of the grinder;

orienting the available grinding modules to the grind pattern as the rail grinder reaches the next segment; and grinding the next segment.

2. The method of claim 1, wherein the step of determining the grind pattern further comprises:

establishing a targeted amount of metal to be removed from each rail of the next segment.

3. The method of claim 2, wherein the step of establishing the targeted amount of metal to be removed further comprises:

evaluating current rail data to identify a depth of grind necessary to remove any defects from each rail of the next segment.

4. The method of claim 3, wherein the current rail data includes one or both of static rail data or real-time rail data.

5. The method of claim 4, wherein static rail data comprises stored data collected by a rail inspection vehicle at a time prior to the step of traversing the railway with the rail grinder.

6. The method of claim 4, wherein real-time data comprises data collected by a rail inspection vehicle operating in front of and in conjunction with the rail grinder.

7. The method of claim 3, wherein the current rail data includes one or more of metal fatigue, current rail head profile and mechanical defects in each rail of the next segment.

8. The method of claim 3, further comprising:

creating the target profile using the depth of grind necessary to remove any defects from each rail in combination with a desired profile for each rail of the next segment.

9. The method of claim 8, wherein the desired profile for each rail vanes between the plurality of segments.

10. The method of claim 8, wherein the step of determining the grind pattern further comprises:

determining a highest operational speed at which the rail grinder can traverse the next segment while grinding to the target profile.

11. The method of claim 10, wherein the step of determining the highest operational speed further comprises:

identifying a minimum number of passes of the rail grinder over the next segment that are necessary to grind to the target profile.

12. The method of claim 11, further comprising:

iteratively calculating the highest operational speed using the identified minimum number of passes of the rail grinder over the next segment.

13. The method of claim 12, further comprising:

determining the grind pattern at each iterative speed calculation using the operational status of the rail grinder and individual grinding parameters of each available grinding module.

14. The method of claim 13, wherein the step of determining the grind pattern at each iterative speed calculation further comprises:

determining an individual arrangement for each available grinding module.

15. The method of claim 14, wherein the individual arrangement for each available grinding module includes one or more of vertical positioning, horizontal positioning and horsepower requirement.

16. The method of claim 14, the step of determining the individual arrangement for each available grinding module further comprises:

identifying each available grinding module as a fixed grinding module or a flexible grinding module.

17. The method of claim 13, wherein the step of determining the grind pattern at each iterative speed calculation further comprises:

determining an individual arrangement for each available grinding module.

18. The method of claim 17, further comprising:

determining if each available grinding module is required to grind a single, continuous surface that achieves the target profile.

19. A railway grinding system, comprising:

a rail grinder including a rail grinding assembly on each side of an on-rail vehicle, wherein each rail grinding assembly comprises a plurality of grinding modules, the rail grinder further including a processing system whereby the rail grinder implements the method of claim 1.

20. The method of claim 1, wherein the step of updating the operational status of the rail grinder in real-time, further comprises:

updating the operational status of each side of the rail grinder to indicate the number of grinding modules available on each side of the rail grinder to grind the next segment, wherein said operational status of each side excludes grinding module on each side that are out of service.

* * * * *